US007862970B2

(12) United States Patent
Hawkins et al.

(10) Patent No.: US 7,862,970 B2
(45) Date of Patent: Jan. 4, 2011

(54) TONER COMPOSITIONS WITH AMINO-CONTAINING POLYMERS AS SURFACE ADDITIVES

(75) Inventors: Michael S. Hawkins, Cambridge (CA); Eric M. Strohm, Burlington (CA); Richard P. N. Veregin, Mississauga (CA); Vladislav Skorokhod, Mississauga (CA); Clive R. Daunton, Rochester, NY (US); Robert D. Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 764 days.

(21) Appl. No.: 11/128,159

(22) Filed: May 13, 2005

(65) Prior Publication Data

US 2006/0257775 A1 Nov. 16, 2006

(51) Int. Cl.
*G03G 9/08* (2006.01)

(52) U.S. Cl. ..... 430/108.22; 430/110.2; 430/137.14; 430/137.1; 430/137.11

(58) Field of Classification Search ..... 430/108.22, 430/110.2, 137.14, 137.1, 137.11
See application file for complete search history.

(56) References Cited

U.S. PATENT DOCUMENTS 2,297,691 A 4/1939 Carlson et al.
2,618,551 A 11/1952 Walkup
2,618,552 A 11/1952 Wise
2,725,305 A 11/1955 Allen et al.
2,791,949 A 5/1957 Simmons et al.
2,874,063 A 2/1959 Greig
2,918,910 A 12/1959 Fink
2,919,171 A 12/1959 Epstein et al.
3,015,305 A 1/1962 Hall et al.
3,526,533 A 9/1970 Jacknow et al.
3,564,556 A 2/1971 Tsukatani et al.
3,590,000 A 6/1971 Palermiti et al.
3,611,419 A 10/1971 Blumenthal
3,655,374 A 4/1972 Palermiti et al.
3,720,617 A 3/1973 Chatterji et al.
3,847,604 A 11/1974 Hagenbach et al.
3,849,186 A 11/1974 Tachick et al.
3,942,979 A 3/1976 Jones et al.
3,944,493 A 3/1976 Jadwin et al.
3,983,045 A 9/1976 Jugle et al.
4,007,293 A 2/1977 Mincer et al.
4,079,014 A 3/1978 Burness et al.
4,155,093 A 5/1979 Fotland et al.
4,160,257 A 7/1979 Carrish
4,240,084 A 12/1980 Tacklind et al.
4,254,424 A 3/1981 Landheer et al.
4,267,556 A 5/1981 Fotland et al.
4,298,672 A 11/1981 Lu
4,365,549 A 12/1982 Fotland et al.
4,394,430 A 7/1983 Jadwin et al.
4,408,214 A 10/1983 Fotland et al.
4,409,604 A 10/1983 Fotland
4,463,363 A 7/1984 Gundlach et al.
4,464,452 A 8/1984 Gruber et al.
4,480,021 A 10/1984 Lu et al.
4,524,371 A 6/1985 Sheridon et al.
4,538,163 A 8/1985 Sheridon
4,558,108 A 12/1985 Alexandru et al.
4,560,635 A 12/1985 Hoffend et al.
4,569,584 A 2/1986 St. John et al.
4,619,515 A 10/1986 Maczuszenco et al.
4,621,039 A * 11/1986 Ciccarelli et al. ..... 430/108.22
4,656,112 A 4/1987 Kawagishi et al.
4,797,344 A * 1/1989 Nakahara et al. ..... 430/108.22
4,845,003 A 7/1989 Kiriu et al.
4,868,600 A 9/1989 Hays et al.
4,937,157 A 6/1990 Haack et al.
4,937,167 A * 6/1990 Moffat et al. ..... 430/137.12
4,984,019 A 1/1991 Folkins
5,010,367 A 4/1991 Hays
5,031,570 A 7/1991 Hays et al.
5,032,872 A 7/1991 Folkins et al.
5,119,147 A 6/1992 Hays
5,134,442 A 7/1992 Folkins et al.
5,144,371 A 9/1992 Hays
5,153,647 A 10/1992 Barker et al.
5,153,648 A 10/1992 Lioy et al.
5,172,170 A 12/1992 Hays et al.
5,178,984 A 1/1993 Nagatsuka et al.
5,206,693 A 4/1993 Folkins
5,212,037 A 5/1993 Julien et al.
5,227,460 A 7/1993 Mahabadi et al.
5,245,392 A 9/1993 Behe et al.
5,253,016 A 10/1993 Behe et al.
5,278,020 A 1/1994 Grushkin et al.
5,290,654 A 3/1994 Sacripante et al.
5,300,992 A 4/1994 Wayman et al.
5,308,734 A 5/1994 Sacripante et al.
5,311,258 A 5/1994 Brewington et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,370,963 A 12/1994 Patel et al.

(Continued)

*Primary Examiner*—Mark F Huff
*Assistant Examiner*—Rachel L Zhang (Burney)
(74) *Attorney, Agent, or Firm*—Oliff & Berridge, PLC

(57) ABSTRACT

A toner composition includes core particles including a polymeric latex and an optional colorant, and amino-containing polymer particles dispersed on an external surface of the particles.

17 Claims, No Drawings

U.S. PATENT DOCUMENTS 5,403,693 A 4/1995 Patel et al.
5,418,108 A 5/1995 Kmiecik-Lawrynowicz et al.
5,510,220 A 4/1996 Nash et al.
5,558,967 A * 9/1996 Nagatsuka et al. ..... 430/108.6
5,593,807 A 1/1997 Sacripante et al.
5,604,076 A 2/1997 Patel et al.
5,648,193 A 7/1997 Patel et al.
5,658,704 A 8/1997 Patel et al.
5,660,965 A 8/1997 Muchajlowskij et al.
5,834,080 A 11/1998 Mort et al.
5,840,462 A 11/1998 Foucher et al.
5,853,906 A 12/1998 Hsieh et al.
5,853,944 A 12/1998 Foucher et al.
5,916,725 A 6/1999 Patel et al.
5,919,595 A 7/1999 Muchajlowskij et al.
5,945,245 A 8/1999 Muchajlowskij et al.
6,017,671 A 1/2000 Sacripante et al.
6,020,101 A 2/2000 Sacripante et al.
6,054,240 A 4/2000 Julien et al.
6,140,003 A 10/2000 Sacripante et al.
6,143,457 A 11/2000 Carlini et al.
6,177,221 B1 1/2001 Maniar et al.
6,210,853 B1 4/2001 Patel et al.
6,251,554 B1 * 6/2001 Hoffend et al. ..... 430/111.35
6,319,647 B1 11/2001 Gutman et al.
6,355,391 B1 3/2002 Van Dusen et al.
6,361,915 B1 3/2002 Van Dusen et al.
6,365,316 B1 4/2002 Stamp et al.
6,416,916 B1 7/2002 Silence et al.
6,699,633 B2 3/2004 Moffat et al.
6,743,559 B2 6/2004 Combes et al.
2001/0005568 A1 * 6/2001 Sokol et al. ..... 430/108.24
2004/0137352 A1 7/2004 McStravick et al.
2004/0152007 A1 * 8/2004 Combes et al. ..... 430/120
2004/0253024 A1 12/2004 Longhenry et al.
2005/0031979 A1 2/2005 McStravick et al.
2005/0095516 A1 * 5/2005 Ohmura et al. ..... 430/45
2005/0100809 A1 * 5/2005 Fujino et al. ..... 430/110.2
2006/0089425 A1 * 4/2006 Chopra et al. ..... 523/206

* cited by examiner

TONER COMPOSITIONS WITH AMINO-CONTAINING POLYMERS AS SURFACE ADDITIVES

BACKGROUND

The present disclosure relates to toners suitable for use in electrostatic imaging processes. More specifically, the present disclosure is directed to toner compositions that can be used in processes such as electrography, electrophotography, ionography, or the like, including processes wherein the toner particles are triboelectrically positively charged. One embodiment of the present invention is directed to a toner comprising particles of a polyester resin, an optional colorant, and amino-containing polymers as surface additives. In embodiments, the toner particles are prepared by an emulsion aggregation process. Another embodiment of the present disclosure is directed to a process which comprises (a) generating an electrostatic latent image on an imaging member, and (b) developing the latent image by contacting the imaging member with charged toner particles comprising a polyester resin, an optional colorant, and amino-containing polymers as surface additives The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion or electron deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference. Generally, the process entails application of charge in an image pattern with an ionographic or electron beam writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Triboelectricity is often not well understood and is often unpredictable because of a strong materials sensitivity. For example, the materials sensitivity results in differences in toner charging when the pigment is changed to provide the required color in color toner applications, making it difficult to provide the same toner charge for each different color, an attribute that is critical to provide a stable color image in the electrophotograhic development system under all printing conditions. Furthermore, to enable "offset" print quality with powder-based electrophotographic development systems, small toner particles (about 5 micron diameter) are desired. Although the functionality of small, triboelectrically charged toner has been demonstrated, concerns remain regarding the long-term stability and reliability of such systems.

In addition, development systems which use triboelectricity to charge toner, whether they be two component (toner and carrier) or single component (toner only), tend to exhibit nonuniform distribution of charges on the surfaces of the toner particles. This nonuniform charge distribution results in high electrostatic adhesion because of localized high surface charge densities on the particles. Toner adhesion, especially in the development step, can limit performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, triboelectric charged particles much more difficult to develop and control.

U.S. Pat. No. 5,834,080, the disclosure of which is totally incorporated herein by reference, discloses controllably conductive polymer compositions that may be used in electrophotographic imaging developing systems, such as scavengeless or hybrid scavengeless systems or liquid image development systems. The conductive polymer compositions includes a charge-transporting material (particularly a charge-transporting, thiophene-containing polymer or an inert elastomeric polymer, such as a butadiene- or isoprene-based copolymer or an aromatic polyether-based polyurethane elastomer, that additionally comprises charge transport molecules) and a dopant capable of accepting electrons from the charge-transporting material. The invention also relates to an electrophotographic printing machine, a developing apparatus, and a coated transport member, an intermediate transfer belt, and a hybrid compliant photoreceptor comprising a composition of the invention.

U.S. Pat. No. 5,853,906, the disclosure of which is totally incorporated herein by reference, discloses a conductive coating comprising an oxidized oligomer salt, a charge transport component, and a polymer binder, for example, a conductive coating comprising an oxidized tetratolyidiamine salt, a charge transport component, and a polymer binder.

While known compositions and processes are suitable for their intended purposes, a need remains for improved marking processes. In addition, a need remains for improved electrostatic imaging processes. Further, a need remains for toners that can be positively charged for improved use in printing systems that utilize, for example, charged area development or tri-level development.

Prior attempts to address these needs included using various surface additives to treat the toner particles. For example, U.S. Patent No. 5,178,984 describes positively chargeable electrophotographic toners. The toners are prepared by adding to prepared toner particles silica fine particles having been surface treated with a homo-or copolymer comprising, as a monomer component, a dialkylaminoalkyl acrylate or a dialkylaminoalkyl methacrylate in the form of a quaternary ammonium salt. The toner is described to provide improved fluidity and improved anti-caking properties while exhibiting satisfactory charging properties and environmental stability and causing no image defects.

SUMMARY

Despite the various toner compositions that are available and have been developed, there remains a need for improved toner compositions, particularly positively chargeable toner compositions. Such needs and others are, in embodiments, addressed by the present disclosure. In particular, the present disclosure provides improved toner compositions that have negatively chargeable toner particles coated with a positively chargeable surface additive.

In particular, the present disclosure provides a toner composition comprising:

core particles comprising a polymeric latex and an optional colorant, and amino-containing polymer particles dispersed on an external surface of said core particles.

DETAILED DESCRIPTION OF PREFERRED EMBODIMENTS

Marking materials of the present disclosure can be used in conventional electrostatic imaging processes, such as electrophotography, ionography, electrography, or the like. Another embodiment of the present disclosure is directed to a process which comprises (a) generating an electrostatic latent image on an imaging member, and (b) developing the latent image by contacting the imaging member with charged toner particles according to the present disclosure. In one embodiment of the present disclosure, the toner particles are charged triboelectrically, in either a single component development process or a two-component development process.

In embodiments of the present disclosure in which the marking particles are used in electrostatic imaging processes wherein the marking particles are triboelectrically charged, toners of the present disclosure can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 30 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 .to about 1 percent by weight of the uncoated carrier particle, although the coating weight may be outside this range.

In a two-component developer, the toner is present in the developer in any effective amount, typically from about 1 to about 10 percent by weight of the carrier, and preferably from about 3 to about 6 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, and the like. Magnetic brush development is more fully described, for example, in U.S. Pat. No. 2,791,949, the disclosure of which is totally incorporated herein by reference; cascade development is more fully described, for example, in U.S. Pat. Nos. 2,618,551 and 2,618,552, the disclosures of each of which are totally incorporated herein by reference; powder cloud development is more fully described, for example, in U.S. Pat. Nos. 2,725,305, 2,918,910, and 3,015,305, the disclosures of each of which are totally incorporated herein by reference. In embodiments, conductive magnetic brush developers can be selected for hybrid jumping development, hybrid scavengeless development, and similar processes, reference U.S. Pat. Nos. 4,868,600; 5,010,367; 5,031,570; 5,119,147; 5,144,371; 5,172,170; 5,300,992; 5,311,258; 5,212,037; 4,984,019; 5,032,872; 5,134,442; 5,153,647; 5,153,648; 5,206,693; 5,245,392; 5,253,016, the disclosures of which are totally incorporated herein by reference. In other embodiments, semi-conductive magnetic brush developers (SCMB) can be selected, reference U.S. patent application Publications Nos. 2004-0137352, 2004-0253024, and 2005-0031979, the disclosures of which are totally incorporated herein by reference.

The toners of the present disclosure comprise particles typically having an average particle diameter of no more than about 13 microns, preferably no more than about 12 microns, more preferably no more than about 10 microns, and even more preferably no more than about 7 microns, although the particle size can be outside of these ranges, and typically have a particle size distribution or GSD equal to no more than about 1.25, preferably no more than about 1.23, and more preferably no more than about 1.20, although the particle size distribution can be outside of these ranges. In some embodiments, larger particles can be preferred even for those toners made by emulsion aggregation processes, such as particles of between about 7 and about 13 microns, although smaller particles such as particles of between about 1 and about 8 microns may be preferred in other embodiments. The toner particles generally comprise a polyester resin, an optional colorant, and amino-containing polymers as surface additives. In preferred embodiments, the toner particles are prepared by an emulsion aggregation process.

The toners of the present disclosure comprise particles comprising a polyester resin and an optional colorant, with or without other optional additives. The resin can be a homopolymer of one ester monomer or a copolymer of two or more ester monomers. Examples of suitable resins include polyethylene terephthalate, polypropylene terephthalate, polybutylene terephthalate, polypentylene terephthalate, polyhexalene terephthalate, polyheptadene terephthalate, polyoctalene-terephthalate, poly(propylene-diethylene terephthalate), poly(bisphenol A-fumarate), poly(bisphenol A-terephthalate), copoly(bisphenol A-terephthalate-copoly (bisphenol A-fumarate), poly(neopentyl-terephthalate), sulfonated polyesters such as those disclosed in U.S. Pat. Nos. 5,348,832, 5,593,807, 5,604,076, 5,648,193, 5,658,704, 5,660,965, 5,840,462, 5,853,944, 5,916,725, 5,919,595, 5,945,245, 6,054,240, 6,017,671, 6,020,101, 6,140,003, 6,210,853, and 6,143,457, the disclosures of each of which are totally incorporated herein by reference, including salts (such as metal salts, including aluminum salts, salts of alkali metals such as sodium, lithium, and potassium, salts of alkaline earth metals such as beryllium, magnesium, calcium, and barium, metal salts of transition metals, such as scandium, yttrium, titanium, zirconium, hafnium, vanadium, chromium, niobium, tantalum, molybdenum, tungsten, manganese, rhenium, iron, ruthenium, osmium, cobalt, rhodium, iridium, nickel, palladium, copper, platinum, silver, gold, zinc, cadmium, mercury, and the like, salts of lanthanide materials, and the like, as well as mixtures thereof) of poly(1,2-propylene-5-sulfoisophthalate), poly(neopentylene-5-sulfoisophthalate), poly(diethylene-5-sulfoisophthalate), copoly(1,2-propylene-5-sulfoisophthalate)-copoly-(1,2-propylene-terephthal ate phthalate), copoly(1,2-propylene-diethylene-5-sulfoisophthalate)-copoly-(1,2-propylene-diethylene-terephthalate phthalate), copoly(ethylene-neopentylene-5-sulfoisophthalate)-copoly-(ethylene-neopentylene-terephthalate-phthalate), copoly(propoxylated bisphenol A)-copoly-(propoxylated bisphenol A-5-sulfoisophthalate), copoly(ethylene-terephthalate)-copoly-(ethylene-5-sulfo-isophthalate), copoly(propylene-terephthalate)-copoly-(propylene-5-sulfo-isophthalate), copoly(diethylene-terephthalate)-copoly-(diethylene-5-sulfo-isophthalate), copoly (propylene-diethylene-terephthalate)-copoly-(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), copoly(ethoxylated bisphenol-A-maleate)-copoly(ethoxylated bisphenol-A-5-sulfo-isophthalate), copoly(propylene-diethylene terephthalate)-copoly(propylene-5-sulfoisophthalate), copoly(neopentyl-terephthalate)-copoly-(neopentyl-5-sulfoisophthalate), and the like, as well as mixtures thereof.

Some examples of suitable polyesters include those of the formula:

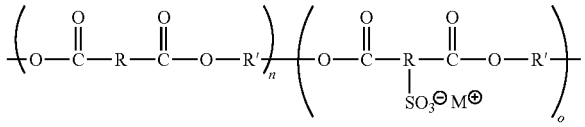

wherein M is hydrogen, an ammonium ion, or a metal ion, R is an alkylene group, typically with from 1 to about 25 carbon atoms, although the number of carbon atoms can be outside of this range, or an arylene group, typically with from 6 to about 24 carbon atoms, although the number of carbon atoms can be outside of this range, R' is an alkylene group, typically with from 1 to about 25 carbon atoms, although the number of carbon atoms can be outside of this range, or an oxyalkylene group, typically with from 1 to about 20 carbon atoms, although the number of carbon atoms can be outside of this range, n and o each represent the mole percent of monomers, wherein n+o=100, and preferably wherein n is from about 92 to about 95.5 and o is from about 0.5 to about 8, although the values of n and o can be outside of these ranges.

Also suitable are those of the formula:

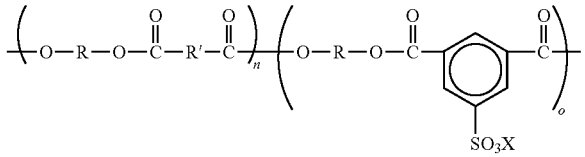

wherein X is hydrogen, an ammonium ion, or a metal ion, R is an alkylene or oxyalkylene group, typically with from about 2 to about 25 carbon atoms, although the number of carbon atoms can be outside of this range, R' is an arylene or oxyarylene group, typically with from 6 to about 36 carbon atoms, although the number of carbon atoms can be outside of this range, and n and o each represent the numbers of randomly repeating segments.

Also suitable are those of the formula:

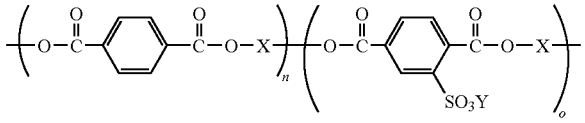

wherein X is a metal ion, X represents an alkyl group derived from a glycol monomer, with examples of suitable glycols including neopentyl glycol, ethylene glycol, propylene glycol, butylene glycol, diethylene glycol, dipropylene glycol, or the like, as well as mixtures, thereof, and n and o each represent the numbers of randomly repeating segments.

Preferably, the polyester has a weight average molecular weight of from about 2,000 to about 100,000, a number average molecular weight of from about 1,000 to about 50,000, and a polydispersity of from about 2 to about 18 (as measured by gel permeation chromatography), although the weight average and number average molecular weight values and the polydispersity value can be outside of these ranges.

The resin is present in the toner particles in any desired or effective amount, typically at least about 75 percent by weight of the toner particles, and preferably at least about 85 percent by weight of the toner particles, and typically no more than about 99 percent by weight of the toner particles, and preferably no more than about 98 percent by weight of the toner particles, although the amount can be outside of these ranges.

Any desired colorant can be employed. Examples of suitable colorants include dyes, pigments, and mixtures thereof, such as carbon black (for example, REGAL 330®), magnetites, phthalocyanines, HELIOGEN BLUE L6900, D6840, D7080, D7020, PYLAM OIL BLUE, PYLAM OIL YELLOW, and PIGMENT BLUE 1, all available from Paul Uhlich & Co., PIGMENT VIOLET 1, PIGMENT RED 48, LEMON CHROME YELLOW DCC 1026, E.D. TOLUIDINE RED, and BON RED C, all available from Dominion Color Co., NOVAPERM YELLOW FGL and HOSTAPERM PINK E, available from Hoechst, CINQUASIA MAGENTA, available from E. I. DuPont de Nemours & Company, 2,9-dimethyl-substituted quinacridone and anthraquinone dyes identified in the Color Index as CI 60710, CI Dispersed Red 15, diazo dyes identified in the Color Index as CI 26050, CI Solvent Red 19, copper tetra (octadecyl sulfonamido) phthalocyanine, x-copper phthalocyanine pigment listed in the Color Index as CI 74160, CI Pigment Blue, Anthrathrene Blue, identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SEIGLN, CI Dispersed Yellow 33 2,5-dimethoxy-4-sulfonanilide phenylazo-4'-chloro-2,5-dimethoxy acetoacetanilide, Permanent Yellow FGL, Pigment Yellow 74, B 15:3 cyan pigment dispersion, commercially available from Sun Chemicals, Magenta Red 81:3 pigment dispersion, commercially available from Sun Chemicals, Yellow 180 pigment dispersion, commercially available from Sun Chemicals, colored magnetites, such as mixtures of MAPICO BLACK.RTM. and cyan components, and the like, as well as mixtures thereof. Other commercial sources of pigments available as aqueous pigment dispersion from either Sun Chemical or Ciba include (but are not limited to) Pigment Yellow 17, Pigment Yellow 14, Pigment Yellow 93, Pigment Yellow 74, Pigment Violet 23, Pigment Violet 1, Pigment Green 7, Pigment Orange 36, Pigment Orange 21, Pigment Orange 16, Pigment Red 185, Pigment Red 122, Pigment Red 81:3, Pigment Blue 15:3, and Pigment Blue 61, and other pigments that enable reproduction of the maximum Pantone color space. Mixtures of colorants can also be employed.

When present, the colorant is present in the toner particles in any desired or effective amount, typically at least about 1 percent by weight of the toner particles, and preferably at least about 2 percent by weight of the toner particles, and typically no more than about 25 percent by weight of the toner particles, and preferably no more than about 15 percent by weight of the toner particles, depending on the desired particle size, although the amount can be outside of these ranges.

The toner particles optionally can also contain charge control additives, such as alkyl pyridinium halides, including cetyl pyridinium chloride and others as disclosed in U.S. Pat. No. 4,298,672, the disclosure of which is totally incorporated herein by reference, sulfates and bisulfates, including distearyl dimethyl ammonium methyl sulfate as disclosed in U.S. Pat. No. 4,560,635, the disclosure of which is totally incorporated herein by reference, and distearyl dimethyl ammonium bisulfate as disclosed in U.S. Pat. Nos. 4,937,157 and 4,560,635, the disclosures of each of which are totally incorporated herein by reference, zinc 3,5-di-tert-butyl salicylate compounds, such as BONTRON E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as BONTRON E-88, available from Orient Chemical Company of Japan, or aluminum compounds as disclosed in U.S. Pat. No. 4,845,003, the disclosure of which is totally incorporated herein by reference, charge control additives as disclosed in U.S. Pat. Nos. 3,944,493, 4,007,293, 4,079,014, 4,394,430, 4,464,452, 4,480,021, and 4,560,635, the disclosures of each of which are totally incorporated herein by reference, and the like, as well as mixtures thereof. Charge control additives are present in the toner particles in any desired or effective amounts, typically at least about 0.1 percent by weight of the toner particles, and typically no more than about 5 percent by weight of the toner particles, although the amount can be outside of this range.

The toner particles of the present disclosure also include at least one surface additive, as a positive charge control surface additive. Preferably, the positive charge control surface additive is an amino-containing polymer.

Examples of suitable amino-containing polymers for use herein are polymers that include, or are modified to include, an amino group. The basic polymer can be, for example, methacrylic acid ester polymers, acrylic acid ester polymers, styrene polymers, styrene type polymers, or copolymers of the above-mentioned monomers, such as styrene-co-methacrylic acid ester polymers, styrene-co-acrylic acid ester polymers and methacrylic acid ester polymers-co-acrylic acid ester polymers and mixtures thereof. It will be appreciated by those skilled in the art, however, that a wide range of polymeric materials may be used herein.

For example, suitable amino-containing polymers for use herein generally include, but are not limited to, homo- or copolymers comprising a dialkylaminoalkyl acrylate or methacrylate (hereinafter simply referred to as dialkylaminoalkyl acrylate, dialkylaminoalkyl methacrylates) and monoalkylaminoalkyl acrylates or methacrylates (herein after simply referred to as monoalkylaminoalkyl acrylate, monoalkylaminoalkyl methacrylates), which may be in the form of a quaternary ammonium salt. Other monomers copolymerizable with the above mentioned monomers that can be used in production of the copolymers include acrylic acid, acrylic esters, methacrylic acid, methacrylic esters, β-carboxyethylacrylate, divinylbenzene, 1,3-butanedioldiacrylate, 1,3-butanedioldimethacrylate, 1,4-butanedioldiacrylate, 1,4-butanedioldimethacrylate, Di-trimethylolpropanetetraacrylate (and the like) styrene, and vinyl acetate. Specific examples of monoalkyl, or dialkyl amine acrylates/methacrylates are; dimethylaminoethyl methacrylate, diethylaminoethyl methacrylate, diisopropylaminoethyl methacrylate, t-butylaminoethyl methacrylate, t-butylaminoethyl acrylate; dibutylaminoethyl acrylate, dibutylaminoethyl methacrylate and the like. These materials are described in detail in U.S. Pat. No. 5,178,984, the entire disclosure of which is incorporated herein by reference, although the polymers are used to functionalize a silica material.

Specific examples of amino-containing polymers include, but are not limited to, copolymers of methylmethacrylate or methylacrylate, styrene or t-butylstyrene and a monoalkyl, or dialkyl amine, such as a dimethylaminoethyl methacrylate, diethylaminoethyl methacrylate, diisopropylaminoethyl methacrylate, or t-butylaminoethyl methacrylate; and the like. Specific examples of copolymer are poly(methylmethacrylate/dimethylaminoethyl methacrylate), poly(methylmethacrylate/tertiary-butylaminoethyl methacrylate), poly (methylmethacrylate/diethylaminoethyl methacrylate), poly (methylmethacrylate/diisopropylaminoethyl methacrylate), poly(styrene/dimethylaminoethyl methacrylate), poly(styrene/tertiary-butylaminoethyl methacrylate), poly(t-butylstyrene/diethylaminoethyl methacrylate), poly(styrene/diisopropylaminoethyl methacrylate) and copolymers with other monoalkyl or dialkyla amino monomers, wherein alkyl contains, for example, from about 1 to about 25, and preferably from 1 to about 10 carbon atoms, such as methyl, ethyl, propyl, butyl, pentyl, hexyl, octyl, nonyl, and the like. Specific examples of suitable amino-containing polymers include, but are not limited to, poly-diisoprpylaminoethylmethacrylate-methyl methacrylate.

The amino-containing polymers for use herein generally are particles in nature, having an average particle size of from about 20 nm to about 500 nm, more preferably from about 40 nm to about 150 nm, although sizes outside these ranges can be used, as desired. The amino-containing polymers preferably has a weight-average molecular weight of from about 5000 to about 4,000,000, particularly about 50,000 to about 1,000,00. The amino-containing polymers preferably has a Tg of about 50° C. to about 132° C. The amino-containing polymers preferably have an amino monomer content of about 0.01 to about 50.0% by weight of total polymer, particularly from about 0.01 to about 20.0% or about 0.1 to about 20.0% by weight of total polymer.

In one embodiment, it is preferred that the amino-containing polymers for use herein are prepared by an emulsion polymerization process, which can be conducted in the presence of a suitable surfactant such as sodium lauryl sulfate. The emulsion polymerization of the amino-containing polymers provides a material that is in the preferable size range to enable the so produced polymers to be readily dispersed and adhered to the toner particle surface. Other processes that provide polymer particles in the preferred size range would also be suitable methods for preparation of the amino-containing polymers herein.

The amino-containing polymers are preferably used as surface additives for the toner particles in any suitable amount, to provide the desired positive-charging properties to the toner composition. In embodiments, for example, the amino-containing polymers can be included in an amount of from about 0.1 to about 20 percent by weight of the toner particles (i.e., the particles without the surface additives), more preferably in an amount of from about 0.5 to about 10% by weight. Most preferably, the amino-containing polymers is included in an amount of from about 1 to about 5 percent by weight of the toner particles. However, it will be appreciate that amounts outside of these ranges can be used, as desired.

The amino-containing polymer external surface additives can be incorporated in the toner composition in any desired manner. For example, the amino-containing polymers can be added during the aggregation process, or blended onto the formed particles. Preferably, the amino-containing polymers are incorporated into the toner composition in a blending step after the toner particles themselves are formed.

Still more preferably, in embodiments, the amino-containing polymers are included as surface additives in particle form, where the particles consist only of, or consist essentially of, only the amino-containing polymers. That is, it is preferred that the amino-containing polymers be included by themselves, rather than in the form of the amino-containing polymers coated or otherwise applied to the surface of other additives such as silane particles. Of course, in this embodiment, this preference does not preclude the use of other toner particle surface additives, such as treated or untreated silica particles, so long as they are added as separate particles from the amino-containing polymers. In fact, particular advantages can be obtained in embodiments where multiple surface additives are used, such as where the amino-containing polymers are added for positive charging properties, and treated or untreated silica particles are added for improved flow properties.

Thus, if desired, other conventional external surface additives can also be incorporated into the toner composition, in addition to the above-described amino-containing polymers. Examples of such optional external surface additives include metal salts, metal salts of fatty acids, colloidal silicas, and the like, as well as mixtures thereof. When present, such external additives can be present in any desired or effective amount, typically at least about 0.1 percent by weight of the toner particles, and typically no more than about 2 percent by weight of the toner particles, although the amount can be outside of this range, as disclosed in, for example, U.S. Pat. Nos. 3,590,000, 3,720,617, 3,655,374 and 3,983,045, the disclosures of each of which are totally incorporated herein by reference. Preferred additives include zinc stearate and AEROSIL R812® silica as flow aids, available from Degussa. The external additives can be added during the aggregation process or blended onto the formed particles.

Suitable and preferred materials for use in preparing toners herein will now be discussed.

Any binder resin suitable for use in toner may be employed without limitation. Further, toners prepared by chemical methods (such as emulsion/aggregation) and physical methods (such as grinding) may be equally employed. Specific suitable toner examples are as follows.

The toner can be a polyester toner particle, such as is which is known in the art. Polyester toner particles created by the emulsion/aggregation (EA) process are illustrated in a number of patents, such as U.S. Pat. Nos. 5,593,807, 5,290,654, 5,308,734, and 5,370,963, each of which is incorporated herein by reference in its entirety. The polyester may comprise any of the polyester materials described in the aforementioned references. As these references fully describe polyester EA toners and methods of making the same, further discussion on these points is omitted herein.

The toner can be a styrene/acrylate toner particle that is also known in the art. Styrene/acrylate toner particles created by the EA process are illustrated in a number of patents, such as U.S. Pat. Nos. 5,278,020, 5,346,797, 5,344,738, 5,403,693, 5,418,108, and 5,364,729, each of which is incorporated herein by reference in its entirety. The styrene/acrylate may comprise any of the materials described in the aforementioned references. As these references fully describe styrene/acrylate EA toners and methods of making the same, further discussion on these points is omitted herein.

The toner, in embodiments, can also be generated by well known processes other than by EA processes. Such conventional jetted toner particles are illustrated in a number of patents, such as U.S. Pat. Nos. 6,177,221, 6,319,647, 6,365,316, 6,416,916, 5,510,220, 5,227,460, 4,558,108, and 3,590,000, each of which is incorporated herein by reference in its entirety. The conventional jetted toners comprise materials described in the aforementioned references. As these references fully describe conventional jetted toners made by processes other than the EA process and methods of making the same, further discussion on these points is omitted herein.

The toner particles of the present disclosure are preferably prepared by an emulsion aggregation process. The emulsion aggregation process can entail (1) preparing a colloidal solution comprising a polyester resin and an optional colorant, and (2) adding to the colloidal solution an aqueous solution containing a coalescence agent comprising an ionic metal salt to form toner particles. In embodiments of the present invention wherein the polyester resin is a sulfonated polyester (wherein some of the repeat monomer units of the polymer have sulfonate groups thereon), one preferred emulsion aggregation process comprises admixing a colloidal solution of sulfonated polyester resin with the colorant, followed by adding to the mixture a coalescence agent comprising an ionic metal salt, and subsequently isolating, filtering, washing, and drying the resulting toner particles. In a specific embodiment, the process comprises (i) mixing a colloidal solution of a sodio-sulfonated polyester resin with a particle size of from about 10 to about 80 nanometers, and preferably from about 10 to about 40 nanometers, and colorant; (II) adding thereto an aqueous solution containing from about 1 to about 10 percent by weight in water at neutral pH of a coalescence agent comprising an ionic salt of a metal, such as the Group 2 metals (such as beryllium, magnesium, calcium, barium, or the like) or the Group 13 metals (such as aluminum, gallium, indium, or thallium) or the transition metals of Groups 3 to 12 (such as zinc, copper, cadmium, manganese, vanadium, nickel, niobium, chromium, iron, zirconium, scandium, or the like), with examples of suitable anions including halides (fluoride, chloride, bromide, or iodide), acetate, sulfate, or the like; and (iii) isolating and, optionally, washing and/or drying the resulting toner particles. In embodiments wherein uncolored particles are desired, the colorant is omitted from the preparation.

In an alternative embodiments, such as where styrene/acrylates are desired, this process entails (1) preparing a colorant (such as a pigment) dispersion in a solvent (such as water), which dispersion comprises a colorant, a first ionic surfactant, and an optional charge control agent; (2) shearing the colorant dispersion with a latex mixture comprising (a) a counterionic surfactant with a charge polarity of opposite sign to that of said first ionic surfactant, (b) a nonionic surfactant, and (c) a resin, thereby causing flocculation or heterocoagulation of formed particles of colorant, resin, and optional charge control agent to form electrostatically bound aggregates, and (3) heating the electrostatically bound aggregates to form stable aggregates of at least about 1 micron in average particle diameter. Toner particle size is typically at least about 1 micron and typically no more than about 7 microns, although the particle size can be outside of this range. Heating can be at a temperature typically of from about 5 to about 50° C. above the resin glass transition temperature, although the temperature can be outside of this range, to coalesce the electrostatically bound aggregates, thereby forming toner particles comprising resin, optional colorant, and optional charge control agent. Alternatively, heating can be first to a temperature below the resin glass transition temperature to form electrostatically bound micron-sized aggregates with a narrow particle size distribution, followed by heating to a temperature above the resin glass transition temperature to provide coalesced micron-sized toner particles comprising resin, optional colorant, and optional charge control agent. The coalesced particles differ from the uncoalesced aggregates primarily in morphology; the uncoalesced particles have greater surface area, typically having a "grape cluster" shape, whereas the coalesced particles are reduced in surface area, typically having a "potato" shape or even a spherical shape. The particle morphology can be controlled by adjusting conditions during the coalescence process, such as pH, temperature, coalescence time, and the like. Optionally, an additional amount of an ionic surfactant (of the same polarity as that of the initial latex) or nonionic surfactant can be added to the mixture prior to heating to minimize subsequent further growth or enlargement of the particles, followed by heating and coalescing the mixture. Subsequently, the toner particles are washed extensively to remove excess water soluble surfactant or surface absorbed surfactant, and are then dried to produce (optionally colored) polymeric toner particles. An alternative process entails using a flocculating or coagulating agent such as poly(aluminum chloride) instead of a counterionic surfactant of opposite polarity to the ionic surfactant in the latex formation; in this process, the growth of the aggregates can be slowed or halted by adjusting the solution to a more basic pH (typically at least about 7 or 8, although the pH can be outside of this range), and, during the coalescence step, the solution can, if desired, be adjusted to a more acidic pH to adjust the particle morphology. The coagulating agent typically is added in an acidic solution (for example, a 1 molar nitric acid solution) to the mixture of ionic latex and dispersed optional colorant, and during this addition step the viscosity of the mixture increases. Thereafter, heat and stirring are applied to induce aggregation and formation of micron-sized particles. When the desired particle size is achieved, this size can be frozen by increasing the pH of the mixture, typically to from about 7 to about 8, although the pH can be outside of this range. Thereafter, the temperature of the mixture can be increased to the desired coalescence temperature, typically from about 80 to about 95° C., although the temperature can be outside of this range. Subsequently, the particle morphology can be adjusted by dropping the pH of the mixture, typically to values of from about 4.5 to about 7, although the pH can be outside of this range.

When particles are prepared without a colorant, the latex (usually around 40 percent solids) is diluted to the right solids loading (of around 12 to 15 percent by weight solids) and then under identical shearing conditions the counterionic surfactant or polyaluminum chloride is added until flocculation or heterocoagulation takes place.

Examples of suitable ionic surfactants include anionic surfactants, such as sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC®, available from Kao, DOWFAX®, available from Dow Chemical Co., and the like, as well as mixtures thereof. Anionic surfactants can be employed in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

Examples of suitable ionic surfactants also include cationic surfactants, such as dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof. Cationic surfactants can be employed in any desired or effective amounts, typically at least about 0.1 percent by weight of water, and typically no more than about 5 percent by weight of water, although the amount can be outside of this range. Preferably the molar ratio of the cationic surfactant used for flocculation to the anionic surfactant used in latex preparation from about 0.5:1 to about 4:1, and preferably from about 0.5:1 to about 2:1, although the relative amounts can be outside of these ranges.

Examples of suitable nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®), and the like, as well as mixtures thereof. The nonionic surfactant can be present in any desired or effective amount, typically at least about 0.01 percent by weight of monomers used to prepare the copolymer resin, and preferably at least about 0.1 percent by weight of monomers used to prepare the copolymer resin, and typically no more than about 10 percent by weight of monomers used to prepare the copolymer resin, and preferably no more than about 5 percent by weight of monomers used to prepare the copolymer resin, although the amount can be outside of these ranges.

The emulsion aggregation process suitable for making the toner materials for the present toner compositions has been disclosed in previous U.S. patents. For example, U.S. Pat. No. 5,290,654, the disclosure of which is totally incorporated herein by reference, discloses a process for the preparation of toner compositions which comprises dissolving a polymer, and, optionally a pigment, in an organic solvent; dispersing the resulting solution in an aqueous medium containing a surfactant or mixture of surfactants; stirring the mixture with optional heating to remove the organic solvent, thereby obtaining suspended particles of about 0.05 micron to about 2 microns in volume diameter; subsequently homogenizing the resulting suspension with an optional pigment in water and surfactant; followed by aggregating the mixture by heating, thereby providing toner particles with an average particle volume diameter of from between about 3 to about 21 microns when said pigment is present.

U.S. Pat. No. 5,308,734, the disclosure of which is totally incorporated herein by reference, discloses a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

Other emulsion aggregation process, which can be utilized for forming the toner particles used herein, are disclosed in, for example, the following U.S. Patents, the entire disclosures of which are incorporated herein by reference: U.S. Pat. Nos. 5,348,832, 5,593,807, 5,648,193, 5,658,704, 5,660,965, 5,840,462, 5,853,944, 5,916,725, 5,919,595, 5,945,245, 6,054,240, 6,017,671, 6,020,101, 5,604,076, 6,210,853, and 6,143,457.

In a particularly preferred embodiment of the present invention (with example amounts provided to indicate relative ratios of materials), the emulsion aggregation process entails first generating a colloidal solution of a sodio-sulfonated polyester resin (about 300 grams in 2 liters of water) by heating the mixture at from about 20 to about 40° C. above the polyester polymer glass transition temperature, thereby forming a colloidal solution of submicron particles in the size range of from about 10 to about 70 nanometers. Subsequently, to this colloidal solution is added a colorant such as Pigment Blue 15:3, available from Sun Chemicals, in an amount of from about 3 to about 5 percent by weight of toner. The resulting mixture is heated to a temperature of from about 50 to about 60° C., followed by adding thereto an aqueous solution of a metal salt such as zinc acetate (5 percent by weight in water) at a rate of from about 1 to about 2 milliliters per minute per 100 grams of polyester resin, causing the coalescence and ionic complexation of sulfonated polyester colloid and colorant to occur until the particle size of the core composite is from about 3 to about 6 microns in diameter (volume average throughout unless otherwise indicated or inferred) with a geometric distribution of from about 1.15 to about 1.25 as measured by the COULTER COUNTER. Thereafter, the reaction mixture is cooled to about room temperature, followed by filtering, washing once with deionized water, and drying to provide a toner comprising a sulfonated polyester resin and colorant wherein the particle size of the toner is from about 3 to about 6 microns in diameter with a geometric distribution of from about 1.15 to about 1.25 as measured by the COULTER COUNTER. The washing step can be repeated if desired. The particles are now ready for the conductive polymer surface treatment.

When particles without colorant are desired, the emulsion aggregation process entails diluting with water to 40 weight percent solids the sodio-sulfonated polyester resin instead of adding it to a pigment dispersion, followed by the other steps related hereinabove.

Subsequent to synthesis of the toner particles, the toner particles are washed, preferably with water. Thereafter, the above-described external surface additives, such as the amino-containing polymers, are applied to the toner particle surfaces by any suitable method, including but not limited to blending the toner particles with the external surface additives.

The toner compositions of the present invention typically are capable of exhibiting triboelectric surface charging of from about + or −2 to about + or −60 microcoulombs per gram, and preferably of from about + or −10 to about + or −50 microcoulombs per gram, although the triboelectric charging capability can be outside of these ranges. Because the amino-containing polymers are incorporated as surface additives, enabling positive charging of the toners, the triboelectric charge of the toner compositions is preferably from about +2 to about +60 microcoulombs per gram, and preferably from about +10 to about +50 microcoulombs per gram, although the triboelectric charging capability can be outside of these ranges. Charging can be accomplished triboelectrically, either against a carrier in a two component development system, or in a single component development system, or inductively.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Amino-containing Polymer Surface Additives

Amino-containing polymer particles are prepared by an emulsion polymerization process, such as described in U.S. Pat. Nos. 6,361,915 and 6,355,391, the entire disclosures of which are incorporated herein by reference. The process includes 8% by weight diisoprpylaminoethylmethacrylate and 92% by weight methyl methacrylate are gradually mixed into an aqueous solution of sodium lauryl sulfate surfactant, until only about 5 to 30% of the total monomer is emulsified, while maintaining continuous mixing. Initiation of polymeric latex particles is accomplished by rapid addition of a standard ammonium persulfate solution, followed by metered addition of the remaining monomer supply. The metered rate is from about 0.1 to about 5.0 grams per minute, preferably about 1.5 grams per minute, for latex preparations of up to about 350 grams. The mixing is continued after addition of the final amount of monomer to complete polymerization, (high conversion of monomer). Temperature is also maintained with a specified range, about 60 to 70° C. Product particles are obtained and recovered from the prepared latex, by freeze drying.

The resulting powder has a Mw of 263,000, % diisoprpylaminoethylmethacrylate by NMR 6.8%, and mean particle size 98 nm.

Example 2

Preparation of Toner Composition

Toner compositions using the surface additive of Example 1 are prepared. The toner is prepared by mixing the produced amino-containing polymer particles with untreated emulsion/aggregation toner particles at loading levels of the amino-containing polymer particles at 0, 2, 3.4, and 6.7 % by weight, by using a lab-scale SK-M blender. An additional toner blend is also prepared with 6.7% by weight amino-containing polymer particles and 1% by weight H2050 silica obtained from Wacker-Chemie GmbH, the silica being added as a flow aid.

Example 3

Preparation of Developer Composition

Developer compositions using the toner compositions of Example 2 are prepared. The developers are prepared by mixing 10 g of coated carriers with 0.5 grams of the toner compositions of Example 2. The coated carriers are 35 micron Powdertech ferrite cores solution-coated with a coating polymer, carbon black, and Epostar melamine, at a total coating weight of 2%. The components are mixed in a 60-ml glass bottle. The developers are conditioned overnight in A-zone, at 28° C. and 85% relative humidity, or C-zone, at 10° C. and 15% relative humidity) environmental chambers, and charged in a Turbula mixer for 60 minutes. An additional 10 grams of conditioned fresh toner is added to measure admix at 15 seconds and 60 seconds.

Example 4

Testing of Developer Composition

Testing of the toners includes q/d measurements in A- and C-zone at 2 minutes and 60 minutes, and admix at 15 seconds and 60 seconds. The results are presented below, with peak q/d charge quoted in mm of deflection from zero charge at an applied field of 100 V/cm in a charge spectrograph, where a q/d of 1 mm corresponds to a charge of 0.092 femtocoulombs per micron:

| wt % | q/d at 2 min. | | q/d at 60 min. | | admix 15 sec. | | admix 60 sec. | |
|---|---|---|---|---|---|---|---|---|
| polymer additive | A-zone | C-zone | A-zone | C-zone | A-zone | C-zone | A-zone | C-zone |
| 0 | | | −0.7 | −20.6 | | | | |
| 2 | +1.2 | +2.5 | +1.7 | +3.7 | +2.2 | +2.2 | +2.0 | +4.1 |
| 3.4 | +1.6 | +4.2 | +2.3 | +5.9 | +2.5 | +3.2 | +1.9 | +4.0 |
| 6.7 | +3.7 | +13.7 | +3.2 | +11.0 | +2.8 | +5.3 | +2.8 | +6.5 |
| 6.7 + 1% silica | +2.6 | +8.5 | +3.2 | +4.4 | +2.4 | +2.2 | +2.2 | +2.2 |

From this data, it is apparent that the comparative toner (without any amino-containing polymer particles, exhibits negative charging with very high relative humidity sensitivity, as shown by the high negative charge in C-zone but near-zero charge in A-zone. However, the toners that include the amino-containing polymer particles exhibit positive charging and significantly improved stability to relative humidity changes. Further, the q/d values generally increase, becoming more positive, as the loading level of the amino-containing polymer particles is increased.

Document development tests are also conducted using the 6.7 wt % amino-containing polymer particles/1 wt % silica developer composition, in a Xerox DC12 printer. 450 grams of developer is charged into A Turbula mixer for 10 minutes, and placed in a DC 12 black developer housing. Test images are obtained on the photoreceptor under charged area development conditions for tri-level development, which requires that the required DMA and background be met with a sum of Vclean and Vdev be less than 250 V. Vhigh (solid area level) is set at −650 V by using an external voltage source. The laser power is adjusted such that the discharged area potential (white area) is approximately −400 V. Magnetic roll bias voltage is set at 425 V such that negative development voltage of −225 V is applied from the magnetic roll to the. photoreceptor. DMA (developed mass per unit area) is measured by developing a solid area toner patch with known area and weighing the amount of developed toner by collecting it on a Millipore® filter attached to a vacuum pump. DMA testing shows that an acceptable DMA of more than 0.3 mg/cm$^2$ is achieved at a toner concentration (toner weight/carrier weight) from 5.5 to 7.5%.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising:

toner particles comprising a polymeric latex and an optional colorant, and amino-containing polymer particles dispersed directly on and adhered to an external surface of said toner particles, wherein the amino-containing polymer particles are an external surface additive and are not present throughout an interior of the toner particles, the amino-containing polymer particles are present in an amount of from about 0.01 to about 10 percent by weight of the toner particles, and the amino-containing polymer is poly-diisopropylamino-ethyl methacrylate-methyl methacrylate.

2. The toner composition of claim 1, wherein the amino-containing polymer particles are positively chargeable charge control surface additives.

3. The toner composition of claim 1, wherein the amino-containing polymer is in the form of a quaternary ammonium salt.

4. The toner composition of claim 1, wherein the amino-containing polymer has an amino monomer content of from about 0.01 to about 50.0% by weight of total polymer.

5. The toner composition of claim 1, wherein the amino-containing polymer particles consist essentially of said amino-containing polymer.

6. The toner composition of claim 1, wherein the toner particles have an average particle diameter of no more than about 13 microns.

7. The toner composition of claim 1, wherein the polymeric latex comprises a polyester resin.

8. The toner composition of claim 1, wherein the toner particles contain a colorant.

9. The toner composition of claim 8, wherein said colorant is present in an amount of at least about 1 percent by weight of the toner particles, and said colorant being present in an amount of no more than about 25 percent by weight of the toner particles.

10. The toner composition of claim 1, wherein the toner particles are prepared by an emulsion aggregation process.

11. The toner composition of claim 10, wherein the emulsion aggregation process comprises (1) shearing a first ionic surfactant with a latex mixture comprising (a) a counterionic surfactant with a charge polarity of opposite sign to that of said first ionic surfactant, (b) a nonionic surfactant, and (c) the polymeric latex, thereby causing flocculation or heterocoagulation of formed particles of resin to form electrostatically bound aggregates; and (2) heating the electrostatically bound aggregates to form aggregates of at least about 1 micron in average particle diameter.

12. The toner composition of claim 10, wherein the emulsion aggregation process comprises (1) preparing a colloidal solution comprising a polyester resin as the polymeric latex and an optional colorant, and (2) adding to the colloidal solution an aqueous solution comprising a coalescence agent comprising an ionic metal salt, to form toner particles.

13. The toner composition of claim 1, wherein the toner composition is positively charged triboelectrically.

14. A developer comprising:

the toner composition of claim 1, and a carrier.

15. An electrographic image development device, comprising the toner composition of claim 1.

16. The toner composition of claim 1, wherein the amino-containing polymer particles are not applied to the surface of other additives.

17. A process for preparing a toner composition, comprising:

forming toner particles from a polymer resin and an optional colorant, wherein the toner particles are formed by an emulsion/aggregation process; and applying amino-containing polymer particles to the external surface of the toner particles, wherein the amino-containing polymer particles are an external surface additive and are not present throughout an interior of the toner particles, the amino-containing polymer particles are present in an amount of from about 0.01 to about 10 percent by weight of the toner, the amino-containing polymer particles are applied to the surface of the toner particles by blending, and the amino-containing polymer is poly-diisopropylamino-ethyl methacrylate-methyl methacrylate.

* * * * *